United States Patent [19]

Sluys

[11] 4,365,914

[45] Dec. 28, 1982

[54] TRANSVERSE POST-TENSIONED TENDON INTERCONNECTING SYSTEM FOR MARINE FLOATS

[75] Inventor: Wesley W. Sluys, Bellingham, Wash.

[73] Assignee: Builders Concrete, Inc., Bellingham, Wash.

[21] Appl. No.: 199,049

[22] Filed: Oct. 20, 1980

[51] Int. Cl.[3] ..... B63B 35/00

[52] U.S. Cl. ..... 405/221; 405/219; 114/267

[58] Field of Search ..... 405/218, 219, 220, 221; 114/266, 267

[56] References Cited

U.S. PATENT DOCUMENTS

| | | | |
|---|---|---|---|
| 3,091,203 | 5/1963 | Usab | 405/219 X |
| 3,179,076 | 4/1965 | Sheffield | 114/267 |
| 3,448,709 | 6/1969 | Hardwick | 114/266 |
| 3,799,093 | 3/1974 | Thomson | 114/266 |
| 4,041,716 | 8/1977 | Thompson | 405/219 |

FOREIGN PATENT DOCUMENTS

| | | | |
|---|---|---|---|
| 1447670 | 12/1974 | United Kingdom | 114/267 |

*Primary Examiner*—Dennis L. Taylor

*Attorney, Agent, or Firm*—Seed, Berry, Vernon & Baynham

[57] ABSTRACT

A system for connecting a row of concrete marine floats to each other by fastening elongated wales along the upper side edges thereof. Post-tensioned tendons having fastening members mounted on their ends extend transversely through the float. The tendons are relatively thin so that their elongation responsive to tensioning is sufficient to maintain the force of the wales against the float as the wales shrink. However, the tendons, being relatively thin, do not have sufficient strength to withstand the shear forces generated between the float and wales. Consequently, rigid shear-reinforcing sleeves, preferably surrounding the tendons, project from the float into the wales. The tendons may be either rigid rods having threaded ends or flexible wire cables having an anchor mounted at each end.

9 Claims, 4 Drawing Figures

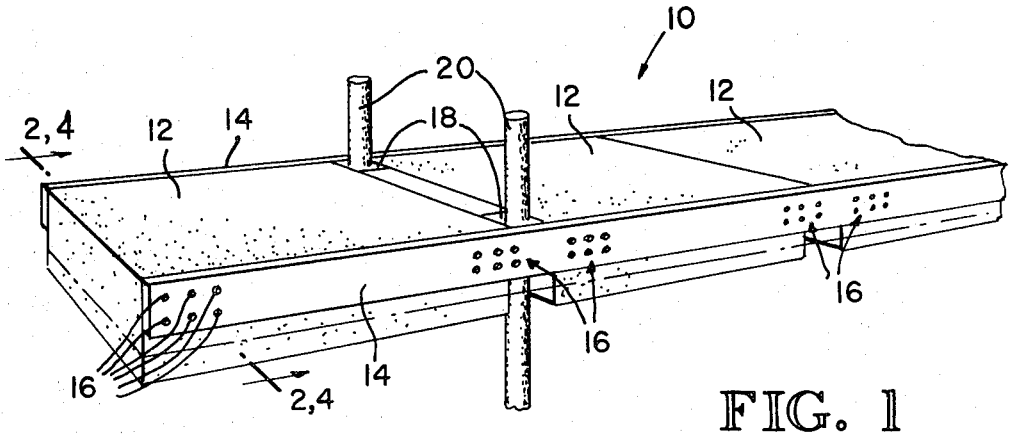
FIG. 1
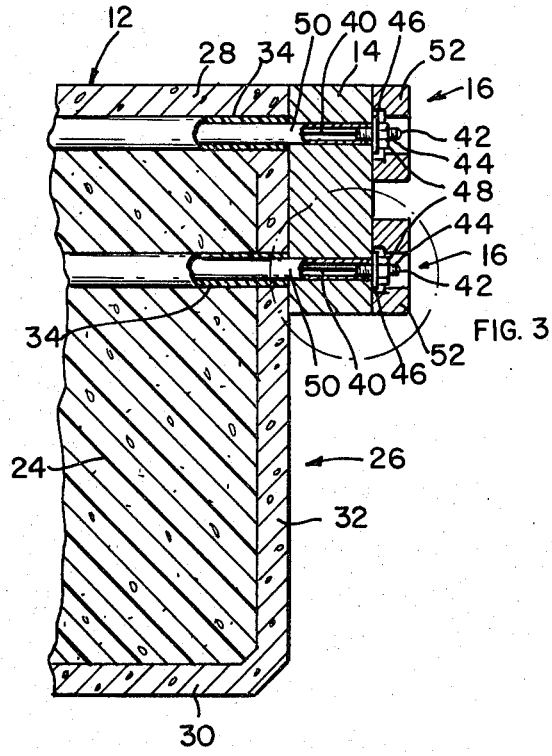
FIG. 2
FIG. 3
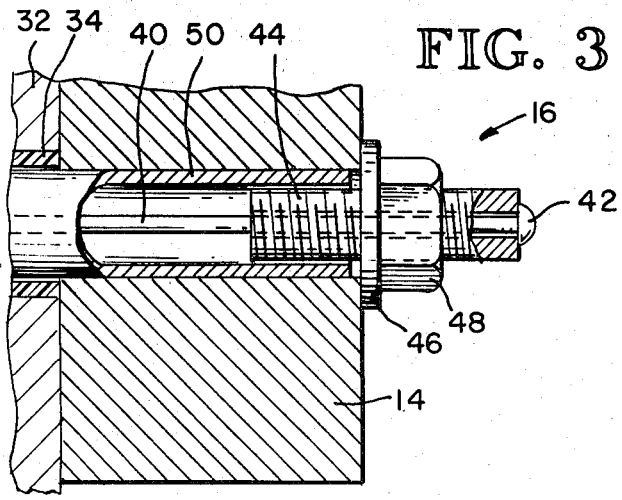
FIG. 3
FIG. 4
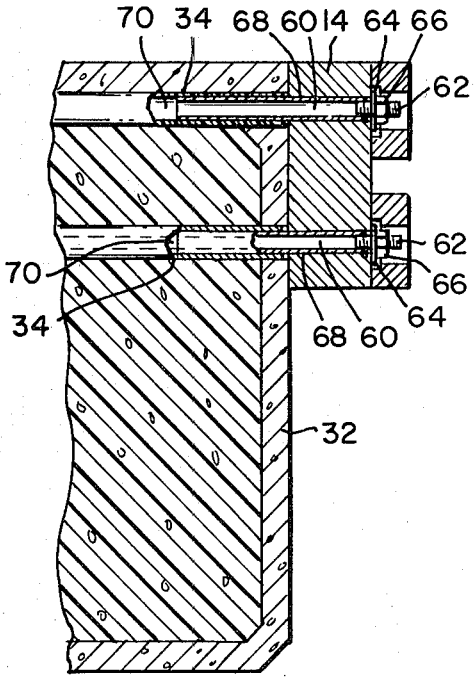

TRANSVERSE POST-TENSIONED TENDON INTERCONNECTING SYSTEM FOR MARINE FLOATS

BACKGROUND OF THE INVENTION

1. Field of the Invention

This invention relates to piers and walkways formed by concrete marine floats and, more particularly, to a system for fastening elongated wales along the upper side edges of the floats to connect the floats to each other.

2. Description of the Prior Art

Marine floats formed by a concrete casing surrounding a buoyant core are commonly used in marinas. Such floats are most commonly connected to each other by elongated, rigid wales extending along the upper side edges of the floats, with the wales bridging the junctions between adjacent floats. The wales are typically fastened to the floats by tie rods extending transversely through the float and projecting through the wales. The ends of the rods are threaded to receive conventional nuts and washers which are torqued against the wales to compress the wales against the float.

The above-described interconnecting system has proven satisfactory in protected locations. However, in waterways subjected to continual wave action of even small amplitudes, it is not possible to maintain the force of the wales against the floats.

It is important for the pressure between the wale and float to be maintained in order to prevent relative movement between the wale and float. Otherwise, the wales and possibly the floats may be quickly damaged.

Several factors are involved in loss of the clamping force of the wales on the float. The primary factor is shrinkage of the wales. The wales, being generally of wood, usually shrink to some extent as they dry. This shrinkage is often significant because the wood forming the wales is initially somewhat wet. Also, the wave action on the floats often causes the nuts to work loose from the ends of the tie rods. In an extreme case, the nuts can be completely removed from the through rods, and the through rods can project from the sides of the floats a large distance. This results in a hazardous boating condition since a boat or its occupant could become impaled on the projecting through rod.

Any movement between the wales and floats responsive to wave action wears away the inner surfaces of the wales, thus making subsequent tightening of the nuts without cracking the wale impossible.

The problems caused by nuts working loose from the ends of the tie rods usually be solved by the use of lock washers or jam nuts, although some problems still remain. For example, plastic inserts frequently used in lock nuts are often damaged by the rough surface of the tie rod threads as the nuts are torqued against the wales. This damage sometimes causes the nuts to lose their locking capability.

The primary problem, that of the shrinkage of the wales, is not as easily solved. Lock nuts and jam nuts do not, of course, compensate for the wood shrinkage. Spring-type nuts are capable of compensating for some shrinkage, but not of the magnitude encountered in the shrinkage of wooden wales. Neither is the use of large washers and extreme tightening of the nuts a solution. Wood fiber loading is normally limited to under 400 pounds per square inch in order to prevent crushing of the wales. The wales are not sufficiently resilient to fully compensate for shrinkage even when torqued to this extent. Also, the tension on the tie rods caused by tightening the nuts to this extent does not elongate the tie rod a sufficient distance to compensate for typical shrinking of the wales. While thinner, and hence more elastic, tie rods would undergo a greater elongation, thinner tie rods do not have sufficient strength to withstand the shear forces generated between the wales and the float. The final problem, namely, wearing of the wale inner surfaces, is essentially caused by non-correction of the first two problems, thus allowing greater relative movement between the wales and floats.

The only satisfactory solution for concrete floats subject to continuous wave action is the periodic tightening of the nuts. However, this solution is very labor intensive since it is only satisfactory if the force between the wale and float is always maintained. Otherwise, the wave action, which can exceed 40,000 cycles per day, can quickly wear a groove on the inside of the wale, which makes tightening the nut on the tie rod without damaging the wale impossible.

Attempts have been made to use steel wales to correct this problem. However, instead of the concrete float wearing away the wale, the steel wale often wears away the concrete float. The results are the same, a gap between the float and wale, and consequent damage.

Another technique for interconnecting a row of concrete marine floats dispenses with the use of wales entirely. This alternative technique utilizes pre-stressed or post-tensioned tendons running along the longitudinal axis of the row which compress the floats against each other end-to-end. This interconnection system also exhibits a number of problems and, if damaged by a storm or boat, requires the replacement of large sections instead of shorter, standard units. However, elongated post-tensioning does maintain the force of the floats against each other because the long length of the post-tensioning tendon allows sufficient elongation to compensate for the changes in the lengths of the floats. In other words, a longitudinal post-tensioned tendon one hundred times longer than a transverse post-tensioned tendon elongates one hundred times more than the transverse post-tensioned tendon for a given tension. Consequently, it is able to compensate for relative movements of its end points one hundred times greater.

SUMMARY OF THE INVENTION

The primary object of the invention is to secure elongated wales along the upper side edges of marine floats in a manner which does not become loose responsive to wave action or shrinking of the wales.

It is another object of the invention to provide a system for interconnecting marine floats using elongated wales which does not require periodic maintenance or adjustment to maintain the pressure of the wales against the float.

It is still another object of the invention to provide a system for interconnecting marine floats which may be used in rough water or in the presence of continuous wave action.

It is a further object of the invention to provide a system for securing marine floats to each other using a wide variety of elongated wale designs.

These and other objects of the invention are provided by a plurality of relatively thin tendons extending transversely through each float with their ends projecting through respective wales running along the upper side edges of the float. Fastening members secured to the ends of the tendons are forced against the wales to compress the wales and tension the tendons, thereby causing sufficient elongation of the tendons to maintain the force between the wales and the floats as the wales shrink. The tendons, being sufficiently thin to compensate for normal shrinkage of the wales, have insufficient shear strength to withstand shear forces generated between the float and wales. Consequently, rigid reinforcing members extending from the floats project into the wales to resist these shear forces. The reinforcing members are preferably hollow sleeves, each surrounding one end of tendon between the floats and wales. The sleeves may be either short lengths of tubing projecting from each side of the float or a continuous tube surrounding the entire tendon within the float. The tendons may be either relatively thin, rigid bars having threads formed at their ends or relatively thin, flexible cables having respective anchoring fixtures formed at their ends.

BRIEF DESCRIPTION OF THE DRAWINGS

FIG. 1 is a perspective view of a row of concrete marine floats interconnected in accordance with the inventive system.

FIG. 2 is a cross-sectional view taken along the line 2—2 of FIG. 1.

FIG. 3 is a detail view of the indicated portion of FIG. 2.

FIG. 4 is a cross-sectional view taken along the line 4—4 of FIG. 1 showing an alternative embodiment of the inventive interconnecting system.

DETAILED DESCRIPTION OF THE INVENTION

A marine pier or walkway 10 formed by a plurality of conventional concrete marine floats 12 is illustrated in FIG. 1. The floats 12 are interconnected in a row by elongated wales 14 extending along the upper side edges of the floats 12. The wales 14 are illustrated in FIG. 1 as being continuous, but it is understood that where several wales 14 are used, the junction between adjacent wales is positioned near the midpoint of each float 12 so that the wales 14 overlap the junction between adjacent floats 12. Alternatively, double wales (not shown) having overlapping ends may be used in place of the single wales 14 illustrated in FIG. 1.

The wales 14 are secured to the floats 12 by fastening members 16 secured to the end of elongated tendons (not shown), as explained in greater detail hereinafter. The fastening members 16 compress the wales 14 aganst the sides of the float 12 so that the wales 14 prevent the floats 12 from pivoting or otherwise moving with respect to each other.

The walkway 10 may also include guide blocks 18 positioned between adjacent floats 12 at spaced-apart locations. The guide blocks 18 receive respective upwardly projecting piles 20 which loosely slide through the blocks 18 responsive to wave and tidal action yet prevent significant transverse movement of the floats 12. Other structures for preventing transverse movement of the floats 12 may, of course, be used. Accordingly, the invention as described herein is not limited in any manner to the use of guide blocks 18 and piles 20, as shown in FIG. 1.

The structure as illustrated in FIG. 1 has been advantageously used in many applications. However, the tie rods (not shown) to which the fastening members 16 are secured, of necessity, have sufficient strength to withstand shear forces generated between the floats 12 and wales 14. Consequently, the tie rods must be relatively thick, and, as a result, they do not stretch appreciably as the fastening members 16 are tightened against the wales 14. Although increasing the compressive force of the fastening members 16 would, of course, produce significant elongation of the tie rods, the wales 14, being generally of wood, are not capable of receiving compressive forces beyond a specific value. Thus, elongation of the tie rods has not been sufficient to compensate for the shrinking of wooden wales 14 responsive to drying. Also, the fastening members 16 have often become loose responsive to continuous wave action. Thus, use of the interconnecting system illustrated in FIG. 1 has required that the fastening members 16 be periodically tightened as the wales 14 shrink.

As illustrated in FIG. 2, the float 12 typically utilizes a buoyant foam core 24 surrounding a poured concrete casing 26 forming a deck 28, a bottom 30, and sidewalls 32. Transverse passages formed by respective conduits 34 are normally provided to receive tie rods (not shown) extending transversely through the float 12. The conduits 34 do not have any structural function, and they terminate at the outer surface of the sidewall 32.

With reference also, now, to FIG. 3, the inventive interconnecting system utilizes a relatively thin, flexible tendon 40 which may be a wire or cable extending through the conduit 34 from one sidewall 32 of the float 12 to the other. Terminating buttons 42 formed at each end of the tendon 40 abut a tubular anchoring member 44 having external threads and an internal through bore. A washer 46 acting as a bearing plate is placed around the anchoring member 44 against the wale 14, and a nut 48 is torqued against the washer 46. As the nut 48 is further tightened, the anchoring members 44 on opposite sides of the float 12 are drawn away from each other, thereby tensioning the tendon 40. The tendon 40, being relatively thin, undergoes significant elongation at a relatively low tension. Consequently, the elongation of the tendon 40 at a tension which is low enough for the wale 14 to withstand is sufficient to compensate for shrinkage of the wale 14. The constant tension of the tendon 40 acting on the nut 48 prevents rotation of the nut 48. However, if necessary, a lock nut (not shown) may be torqued against the nut 48.

In order to provide sufficient elongation of the tendon 40, it must be relatively thin. In fact, it must be so thin that it is not capable of withstanding shear forces typically encountered between the float 12 and wale 14 when the floats 12 are subject to wave action. Consequently, a reinforcing sleeve 50 projects from the sidewall 32 of the float 12 into the wale 14. The sleeve 50 is of sufficient strength to easily withstand the shear forces between the float 12 and wale 14. The reinforcing sleeve 50 terminates short of the washer 46 so that the tension of the tendon 40 compresses the wale 14 against the sidewall 32 of the float. If the washer 46 contacted the end of the sleeve 50, the tension of the tendon 40 would compress the sleeve 50, thereby relieving the pressure of the wale 14 against the sidewall 32. Although the sleeve 50 preferably surrounds the flexible tendon 40, it will be understood that reinforcing members having other shapes, which may or may not surround the tendons 40, may be used as long as the reinforcing members provide sufficient shear strength between the float 12 and wales 14.

As illustrated in FIG. 2, a pair of replaceable wear strips 52 may be secured to the outer surface of the wale 14 to protect the wale 14 from vessels and to protect the vessels from being damaged by the outwardly projecting button 42 and anchoring member 44. This wear strip 52 has been eliminated from FIGS. 1 and 3 for clarity of illustration.

An alternative embodiment of the inventive interconnecting system is illustrated in FIG. 4. In this embodiment, relatively thin rigid tie rods 60 extend transversely through the float 12 within the conduits 34. The tie rods 60 have threads 62 formed at their ends which receive a washer 64 and nut 66. The nut 66 is torqued against the wale 14, thereby compressing the wale 14 against the sidewall 32 of the float 12. The structure illustrated in FIG. 4 is somewhat similar to prior art fastening structures except that the tie rod 60 is sufficiently thin that it undergoes significant elongation as the nut 66 is torqued against the wale 14. Consequently, the tie rods 60 do not have sufficient strength to withstand shear forces typically generated between the sidewall 32 and the wale 14. As with the embodiments of FIGS. 2 and 3, a shear-reinforcing sleeve 68 surrounding the tie rods 60 projects from the sidewall 32 into the wall 14. As with the embodiment of FIG. 2, the ends of the sleeves 68 do not contact the washer 64 so that the tension of the tie rod 60 compresses the wale 14 between the washers 64 and the sidewall 32 of the float 12. Unlike the embodiment of FIG. 2, however, the reinforcing sleeve 68 does not extend transversely across the entire width of the float 12. Instead, the sleeves 68 extend into the float 12 only a short distance. If desired, the sleeves 68 may be secured to the ends of a non-reinforcing tube 70 fabricated from plastic or the like. In this configuration, the conduit 34 may be dispensed with since it is then redundant.

The inventive interconnecting system is thus able to maintain the pressure of the wale 14 against the sidewalls of the float 12 as the wale 14 shrinks. Furthermore, it is not necessary to periodically tighten or adjust the interconnecting structure, and the interconnecting structure is capable of withstanding shear forces typically generated between the float 12 and wale 14.

I claim:

1. A system for interconnecting a row of marine floats, comprising:

respective rigid wales running along the upper side edges of said floats and extending between adjacent floats to bridge the junction therebetween;

a plurality of relatively thin tendons extending transversely through said floats, each terminating in respective fastening means for tensioning said tendons to force said wales against said floats, said tension causing sufficient elongation of said tendons to maintain a force between said wales and float as said wales undergo shrinkage; and rigid shear-reinforcing sleeves surrounding at least some of said tendons and projecting into said wales to resist shear forces generated between said floats and wales, said reinforcing sleeves being isolated from said fastening means so that the tension of said tendons is not imparted to said sleeves.

2. The system of claim 1 wherein said sleeves are continuous tubes surrounding respective tendons and having their ends projecting transversely from said float into respective wales at opposite sides of said float, with the ends of said sleeves terminating short of said fastening means.

3. The system of claim 1 wherein said sleeves are tubular, relatively sturdy extensions mounted on the ends of a relatively weak conduit extending transversely through said float around respective tendons.

4. The system of claim 1 wherein said tendons are relatively thin, rigid bars and wherein said fastening means include threads formed at the ends of said bars and a fastener threaded onto said threads and torqued against the outer surfaces of said wales.

5. The system of claim 1 wherein said tendons are flexible wire cables and wherein said fastening means include respective anchoring fixtures formed at the ends of said cables, a bearing plate contacting the outer surface of each wale, and adjusting means providing relative movement between said anchor and bearing plate in a direction which tensions said cables, thereby stretching said cables and compressing said wales against said float.

6. A concrete marine pier, comprising:

a plurality of concrete marine floats arranged in a row end-to-end;

an elongated, rigid wale running along the upper side edges of said floats, with said wales spanning the junction between adjacent floats;

a plurality of relatively thin tendons extending transversely through said floats and wales, said tendons having a shear strength which is insufficient to withstand the shear stresses produced between said float and wales;

adjustable anchoring means mounted on each end of said tendons, including means for causing relative movement between said anchoring means and tendon in a direction which stretches said tendons and compresses said wales against said floats; and rigid reinforcing sleeves surrounding said tendons and projecting from each side of said float into the adjacent wale a distance less than the entire thickness of said wale, said sleeves having sufficient strength to withstand the shear stresses produced between said float and wales.

7. The marine pier of claim 6 wherein said tendons are relatively thin, rigid bars and wherein said anchoring means include a fastener engaging threads formed at the ends of said bars, said fasteners being torqued against the outer surfaces of said walls, thereby stretching said bar and compressing said wales against said float.

8. The concrete marine pier of claim 6 wherein said tendons are flexible wire cables and wherein said anchoring means include respective anchoring fixtures formed at the ends of said cables, a bearing plate contacting the outer surface of each wale, and adjusting means for providing relative movement between said anchor and bearing plate in a direction which tensions said cables, thereby stretching said cables and compressing said wales against said float.

9. The concrete marine pier of claim 6 wherein said rigid reinforcing sleeves are tubular, relatively sturdy extensions mounted on the ends of a relatively weak conduit extending transversely through said float around respective tendons.

* * * * *